US006160565A

United States Patent [19]

Pollutro et al.

[11] Patent Number: 6,160,565

[45] Date of Patent: Dec. 12, 2000

[54] PRINT CARTRIDGE RF RETURN CURRENT CONTROL

[75] Inventors: Dennis C. Pollutro, Cherry Creek; Orrin Christy, North Tonawanda, both of N.Y.

[73] Assignee: Moore U.S.A., Inc., Grand Island, N.Y.

[21] Appl. No.: 09/209,497

[22] Filed: Dec. 11, 1998

[51] Int. Cl.[7] ..... B41J 2/41

[52] U.S. Cl. ..... 347/123; 174/35 R; 361/816

[58] Field of Search ..... 347/123, 127, 347/128; 361/816, 818; 174/35 R

[56] References Cited

U.S. PATENT DOCUMENTS

| | | | |
|---|---|---|---|
| 1,560,778 | 11/1925 | Goddard . | |
| 2,586,854 | 2/1952 | Myers . | |
| 2,611,010 | 9/1952 | Sass et al. . | |
| 2,788,471 | 4/1957 | Fulmer . | |
| 2,816,273 | 12/1957 | Peck . | |
| 2,963,535 | 12/1960 | Wegener et al. . | |
| 3,904,886 | 9/1975 | Ehling et al. | 361/816 X |
| 3,932,877 | 1/1976 | Ohnishi . | |
| 4,155,093 | 5/1979 | Fotland et al. . | |
| 4,160,257 | 7/1979 | Carrish . | |
| 4,408,214 | 10/1983 | Fotland et al. . | |
| 4,494,129 | 1/1985 | Gretchev . | |
| 4,583,056 | 4/1986 | Takeda et al. . | |
| 4,658,275 | 4/1987 | Fujii et al. . | |
| 4,679,060 | 7/1987 | McCallum et al. . | |
| 4,745,421 | 5/1988 | McCallum et al. . | |
| 4,985,716 | 1/1991 | Hosaka et al. . | |
| 5,014,076 | 5/1991 | Caley, Jr. et al. . | |
| 5,025,273 | 6/1991 | Bowers | 347/218 |
| 5,138,348 | 8/1992 | Hosaka et al. . | |
| 5,315,324 | 5/1994 | Kubelik et al. . | |

*Primary Examiner*—Joan Pendegrass
*Attorney, Agent, or Firm*—Nixon & Vanderhye P.C.

[57] ABSTRACT

A shielding conductive plane, such as a copper layer, which acts as an intermediary layer between an electrically active area and a mechanical substrate of an electron beam cartridge, provides a direct electrical path to control and direct RF currents, minimizing stray electrical noise which interferes with other sensor devices of the printer, such as data system lines and low voltage controlling electronics. The intermediary layer is electrically insulated from the active area and the mechanical substrate by insulating material and through suitable electrical connections provides an adequate way to dissipate the current path of the RF high voltage burst to return to a grounding source. Capacitive coupling of the electrode drivers or the finger electrodes themselves to the mechanical substrate is unnecessary.

16 Claims, 7 Drawing Sheets

PRINT CARTRIDGE RF RETURN CURRENT CONTROL

BACKGROUND AND SUMMARY OF THE INVENTION

The invention relates to electron beam printers and more particularly to the imaging cartridge and the electrical path used to control the high frequency alternating potential, which relates an electrical discharge, which produces electrons. Particularly, the invention uses a shielding conductive plane which acts as an intermediary layer between the electrically active area and the mechanical substrate of an electron beam print cartridge. This intermediary layer is electrically insulated from the active area and the mechanical substrate by other intermediary layers of insulating material. The imaging electron beams are generated in the active area of the print cartridge through the application of high voltage AC bursts between about 160 and 280 volts peak to peak (and all narrower ranges within this broad range) at RF frequencies between about 2.0 and 10.0 mHz (and all narrower ranges within this broad range). Presently configured print cartridges do not provide an adequate way to dissipate the current path of the RF high voltage burst to return to a grounding source. Some of this current is returned through an array of secondary electrodes, normally called the finger electrodes. Most of the current is returned to ground potential through capacitive coupling with the mechanical substrate, and therefore can meander through other mechanical rigidifying structures of the print engine. This can make this structure into a radiating antenna structure, which can cause stray electrical noise, which interferes with other sensitive devices, such as data system lines and low voltage controlling electronics. Use of an intermediary conducting plane according to the invention yields a more direct electrical path to control and direct the RF currents back to ground.

The standard print cartridge used in the majority of electron beam printers used today is based on the 3-electrode cartridge as originally taught in U.S. Pat. No. 4,160,257. This patent is based on the earlier 2-electrode print cartridge of U.S. Pat. No. 4,155,093. This patent teaches a method of generating ions in air by applying an alternating potential between first and second electrodes on opposing sides of a solid dielectric member. The second electrode has an edge surface exposed to the air, which is opposed to the first electrode where electrical discharges produce ions. The patent describes the use of alternating potentials between 60 Hz and 4 mHz. The first electrode is commonly referred to as the RF drive line (RF—radio frequency) and the second electrode, the finger electrode. The solid dielectric material between the opposing electrodes is typically mica or a form of deposited dielectric paste. The alternating potential RF burst typically has an amplitude of 1.5–2.0 kilovolts at 500 kHz frequency with pulse durations from 20 to 50 microseconds.

U.S. Pat. No. 4,160,257, teaches the use of a third electrode structure (the screen electrode) to shape or focus the ionic beam which produces the electrostatic image. Mention is made of a driving RF potential with an amplitude of 1.0 kV at a frequency of 500 kHz. These cited patents only teach the basic electrode structure, function, and approximate configurations. Nothing is taught pertaining to the current flowing within the system or the mounting structure, which would serve as a mechanical platform and also a ground plane, which would react with the driving potentials electrically. In U.S. Pat. No. 4,408,214 (the disclosure of which is hereby incorporated by reference herein), a method and apparatus are described for the enhanced performance of the print cartridge while operating at elevated temperatures. A mounting block is described adjacent to the RF drive electrode to prevent heat build-up. This mounting block is described as being made of aluminum or stainless steel. Attached to the mounting block is a heating element which can raise the temperature of the cartridge structure while being controlled by a thermocouple device mounted in the region of ionic production.

Enhanced descriptions of print cartridge structure are taught in U.S. Pat. Nos. 4,679,060 and 4,745,421. These both describe a print cartridge with a stiff spine attached to the cartridge substrate to make the entire structure rigid. The substrate is now used to create a flat frame of reference and also serve as a handle.

Driving and bias potentials are often mentioned in their relationships to the cartridge electrodes, but a descriptive illustration of the electrical layout is taught in U.S. Pat. No. 4,494,129 (the disclosure of which is hereby incorporated by reference herein). Described are the basic illustrative paths for the RF oscillator alternating potential, finger electrode drivers, and the screen electrode. U.S. Pat. Nos. 5,315,324 and 5,014,076 (the disclosures of which are hereby incorporated by reference herein) teach the most recent knowledge relating to the function of the print cartridge and how charge carriers are generated to form an electrostatic latent image on a rotary dielectric member.

Through all of the descriptions in the above patents, nothing is disclosed concerning the need for the return path of the RF drive line voltage to ground potential. The current commercial Midax 300 print cartridges used by Moore U.S.A. of Lake Forest, Ill., are all made with an intermediary conducting plane made of copper, whose purpose is to dissipate the localized heat concentration points in the active areas of the cartridge. No mention has ever been made of its electrical coupling to the rest of the cartridge, however, and this layer is electrically isolated from ground potential within the machine and may or may not have enough capacitive coupling to affect the RF return current path.

Conventional electron beam imaging cartridge assemblies have a voltage drop that is developed across ground, power, control, or data lines that share current with a twelve inch piece of 20 gauge wire. On the right side printed circuit board (PCB) current path 3 amps of current are coupled to the left side of the finger electrode and on the left side of the PCB current path the current path is not well defined. When the current path hits the printer frame there is no predictability on exactly what path it is going to take. The traditional path of the current in an amp 8 inch DPI card which is via the fingers to the PCD capacitance, the left screen connection, through the screen, and then connecting to the right finger capacitance to the source generator. When using a 600 DPI, 18 inch, cartridge a screen electrode can no longer be used for a current carrying conductor since it is split into four sections that are connected with a high resistive epoxy that cannot handle 3 amps of current. If the screen were one piece it still would be risky to run current through it because of the voltage gradient that would be developed across. Although the screen electrode is not a 20 gauge wire it will still develop about ±10 volts end to end due to its inductance. Therefore, if the screen is an RF circuit it will cause significant problems. All of these difficulties ultimately end up causing stray electrical noise, making effective operation of the electron beam printed far from optimum.

According to the present invention the problems, as described above, with respect to conventional electron beam printers has been solved utilizing shielding isolated from the cartridge frame (also called a handle) and connected to each cluster of RF connections found at each corner of the cartridge. The shielding provides a defined path for the RF return currents, and effectively intercepts parasitic capacitance to the frame/handle.

According to one aspect of the present invention an electron beam imaging cartridge assembly is provided comprising the following components: A mechanical cartridge frame at least partially of electrically conductive material, and connected to electrical ground. An ion generator laminate, including electrodes, for generating electron printing beams. A plurality of RF generators connected to the ion generator laminate. Shielding of electrically conductive material connected by an electrical insulator to the mechanical cartridge frame, and connected between the laminate and the mechanical cartridge frame. And a plurality of electrical connections between the RF generators and the shielding which provide a defined path for RF return currents and intercept parasitic capacitance to the mechanical cartridge frame.

Typically the mechanical cartridge frame/handle comprises an active area and left and right sides, and the shielding is provided on and electrically insulated from all of the active area and the left and right sides of the mechanical cartridge frame. The shielding may comprise a copper layer, and the electrical insulator for connecting the shielding to the frame/handle may be any suitable conventional insulator or insulators (one piece, layered, etc.), the details thereof not being critical.

Typically the laminate includes left and right finger electrodes connected to left and right drivers, respectively, on left and right driver boards, respectively; and the left and right drivers are operatively substantially directly electrically connected to the electrical connections. Alternatively, and more desirably, the left and right drivers are electrically connected to the electrical connections to the shielding substantially only through the RF generators. Also, the left and right drivers are connected to logic control, and the logic controls are preferably electrically connected to the electrical connections to the shielding substantially only through the RF generators.

Typically, the mechanical cartridge frame is constructed of aluminum where connected to the shielding through the electrical insulation, and where connected to ground. A continuous path of aluminum is provided between the connection to the shielding, and the connection to ground. Typically, the laminate includes the screen electrode, and the screen electrode is not in an RF return current path.

According to another aspect of the present invention an electron beam printer cartridge subassembly is provided comprising: A mechanical cartridge frame at least in part of electrically conductive material connected to electrical ground, and comprising an active area and left and right sides; and shielding of electrically conductive material connected through an electrical insulator to all of the active area and left and right sides of the mechanical cartridge frame. The shielding typically comprises a copper layer, and the mechanical cartridge frame is preferably constructed of aluminum, as described above.

According to another aspect of the present invention there is provided a method of minimizing ground current through a printer frame in an electron beam printer having a mechanical cartridge frame at least partially of electrically conductive material, and connected to electrical ground; an ion generator laminate, including electrodes, for generating electron printing beams; and a plurality of RF generators connected to the ion generator laminate. The method comprises: (a) Mounting shielding of electrically conductive material connected by an electrical insulator to the mechanical cartridge frame. (b) Connecting the shielding between the laminate and the mechanical cartridge frame. And (c) providing a plurality of electrical connections between the RF generators and the shielding which provide a defined path for RF return currents to the RF generators, and which intercept parasitic capacitance to the mechanical cartridge frame.

Typically, the laminate includes left and right finger electrodes connected to left and right drivers, respectively, and left and right driver boards, respectively; and the method further comprises (d) electrically connecting the left and right drivers to the plurality of electrical connections substantially only through the RF generators. The invention is highly advantageous compared to conventional print cartridges. Also according to the present invention (a)–(d) are practiced to reduce the hybrid load capacitance by at least about ½, decrease the finger electrode rise and fall times by at least about ½, and reduce the unswitched ground currents through the cartridge frame by at least about 15 db, compared to if (a)–(d) are not practiced.

By utilizing the invention it is possible to effectively construct a 600 DPI, 18 inch, electron beam printer imaging cartridge assemblies. It is a primary object of the present invention to construct such cartridge assemblies and associated subassemblies, and to utilize a method of utilization thereof which minimize the electrical noise which can interfere with other sensitive devices associated with an electronic beam printer. This and other objects of the invention will become clear from a detailed inspection of the invention and from the appended claims.

DETAILED DESCRIPTION OF THE DRAWINGS

Figure 1:
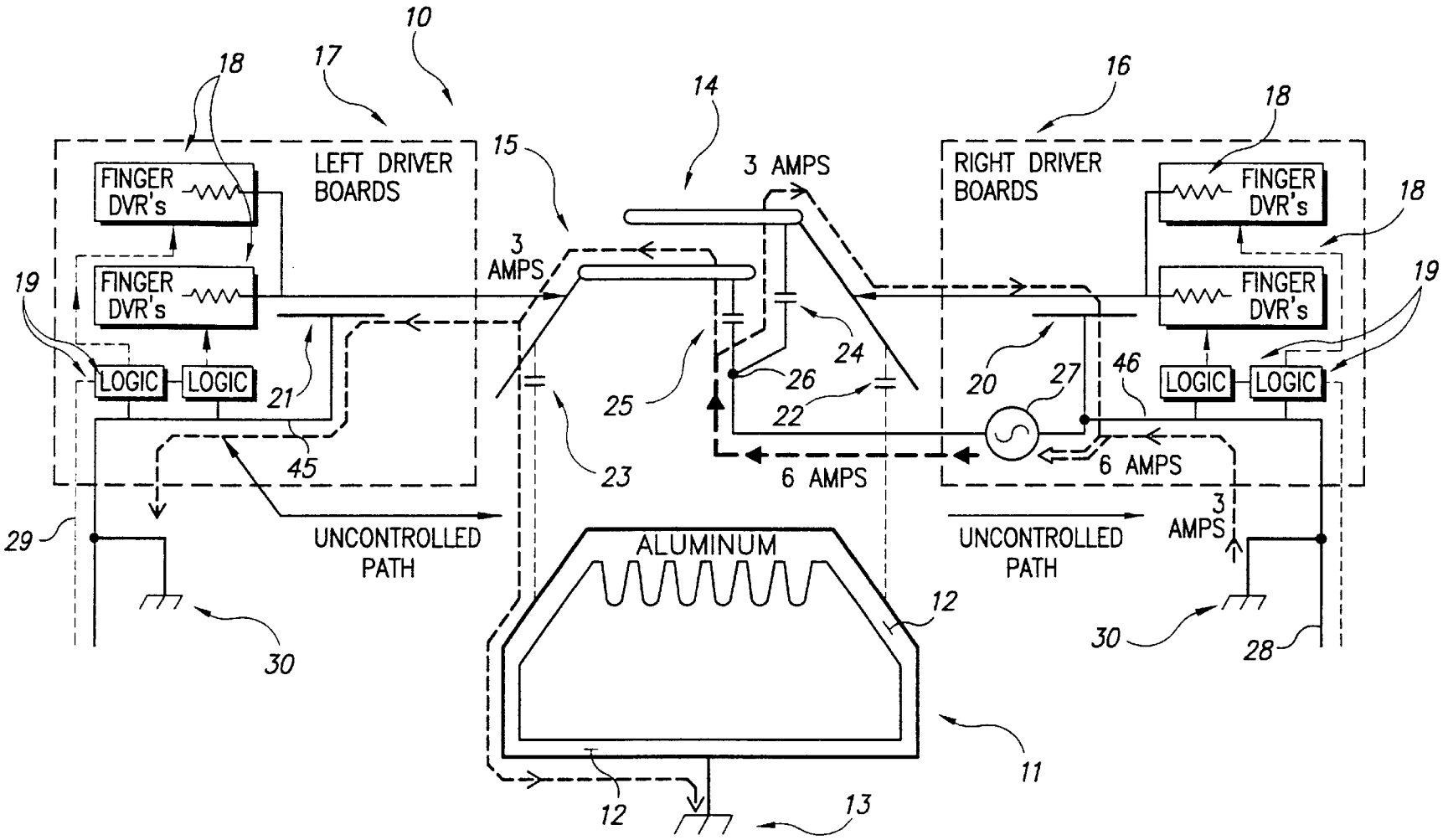
Fig. 1 PRIOR ART
FIG. 1 is a schematic representation of one of 19RF channels (right board) of a conventional 600 DPI 18 inch electron beam imaging cartridge assembly, but not showing screen electrode connections for clarity of illustration.

FIG. 1 schematically illustrates a conventional Delphax 600 DPI 18 inch electron beam printer imaging cartridge assembly, only with the screen electrode not shown for clarity of illustration. It includes a mechanical cartridge frame (also called a handle) shown generally by reference numeral 11, which is of at least partially electrically conductive material. Preferably an entire border 12 of aluminum is provided, and the aluminum of the frame/holder 11 is connected to a ground for the entire printer frame. Connected to the frame/handle 11 is an ion generator laminate which includes an RF drive or electrode, and finger electrodes such as a plurality of right finger electrodes (e.g. 288) 14 and a plurality of left finger electrodes (e.g. 288) 15. A dielectric is provided between the driver electrode and the finger electrodes 14, 15, and a screen electrode, which provides control, is also associated therewith. The ion generator laminate construction, as well as its connection to the cartridge frame/handle 11, are well known per se, and are shown in U.S. Pat. Nos. 4,408,215 and 5,315,324, the disclosures of which have been incorporated by reference herein.

The assembly 10 also includes right driver boards 16, left driver boards 17, finger drivers 18 for driving the electrodes 14, 15, and logic controls shown generally by reference numeral 19 in FIG. 1 for the finger drivers 18. Finger PCB capacitance is provided as indicated schematically at 20 and 21 in FIG. 1, typically having a value of 4600 PF per side (that is for each of the capacitances 20, 21). There are also capacitors 22, 23 which provide finger capacitance to the cartridge frame/handle 11, typically a value of about 3460 PF. The assembly 10 also typically has capacitance built into the connections between the finger electrodes 14, 15 and the RF line 26 as shown schematically at 24, 25 in FIG. 1, the capacitances 24 and 25 each being about 90 PF. The assembly 10 further comprises a plurality of RF generators, one being shown schematically at 27 in FIG. 1, typically ten per side. FIG. 1 also illustrates the right driver cables 28 and the left driver cables 29 which are typically connected to the power supply frame ground illustrated schematically at 30 in FIG. 1.

FIG. 1 tries to map the RF current flow of assembly 10 starting at the right driver board RF generator (27). Current leaves the generator 27 and arrives at the RF line 26 at a level of about 6 amps. The current is then coupled to the left and right set of fingers 14, 15 via capacitance coupling of the RF to the finger lines, indicated at 24, 25. It is here where the current is split. The right side fingers 14 carry three of the six amps of current back to the right driver board 16 via the right finger connections for the fingers 14. At the entrance of the right driver board each of the fingers (typically 288 of them) are capacitively coupled, as indicated at 20, to the return side of the generators 27. As each line shares the three amps of current (1/288 of 3 amps) the voltage drop across any one line is low (about 8 volts). However, the remaining coupling to the left set of fingers 15 results in adverse consequences.

The left side current is not well defined. The current leaves the left side fingers 15 forming two paths. The first is through the left driver board 17 electronics and down the power, control, and data cables arriving at the right RF generator 27 returned via its power, control, and data cables. The second path is via the parasitic capacitance of the fingers 14, 15 to the cartridge frame 11 (see 22, 23 in FIG. 1) to frame ground 13. The current then passes through the printer's frame up through the right PCB's 16 power controlling data cables (28). At this point when the current hits the printer frame there is no way to predict exactly where the current will go. Therefore, as indicated by the arrows and labeling in FIG. 1, there is an uncontrolled path. It is this uncontrolled path that has been found to cause the stray electrical noise which interferes with other sensitive devices of the printer, such as data system lines and low voltage controlling electronics.

Figure 2:
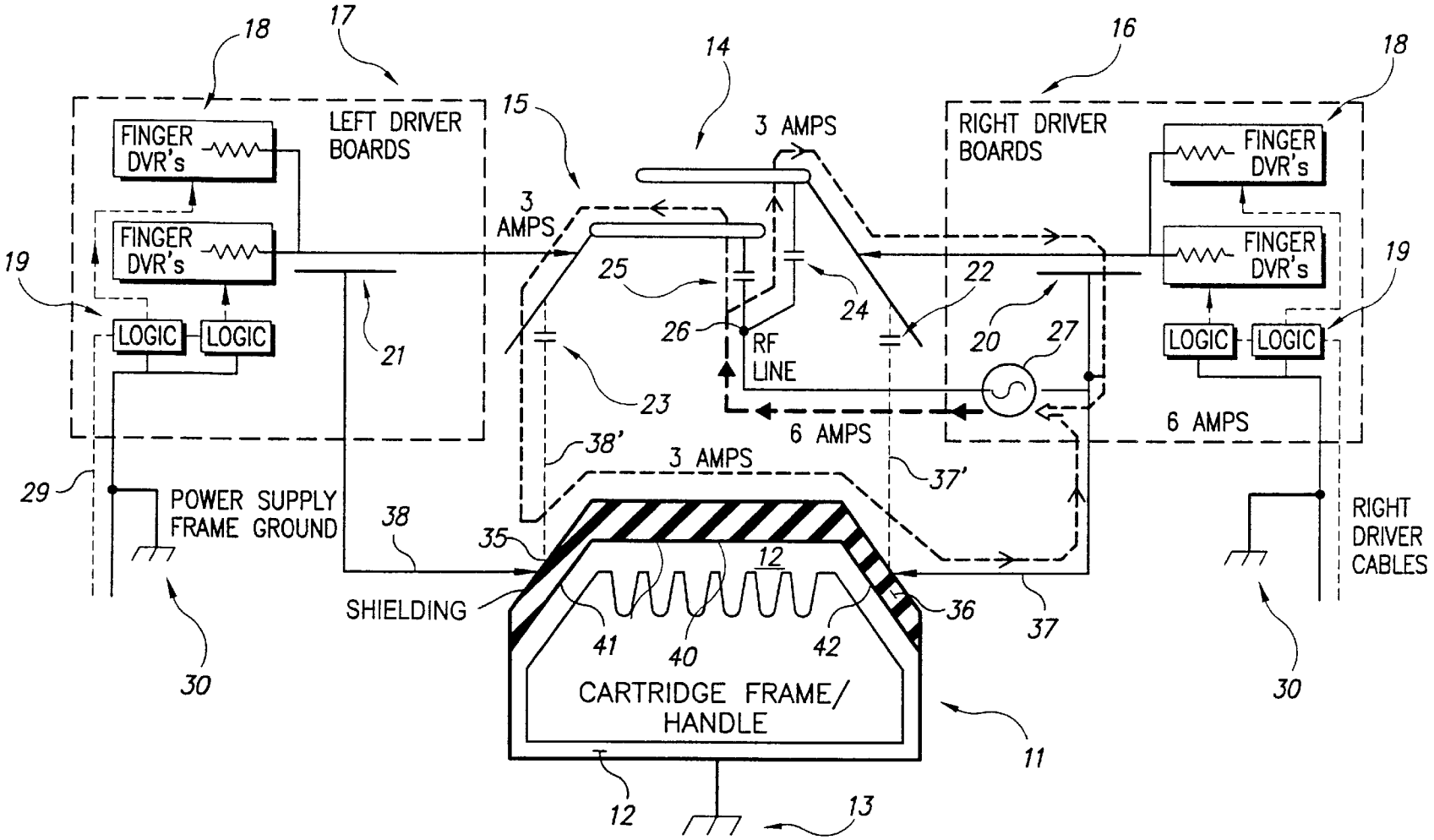
FIG. 2 is a view like that of FIG. 1 only showing an assembly according to one aspect of the present invention.
Figure 3:
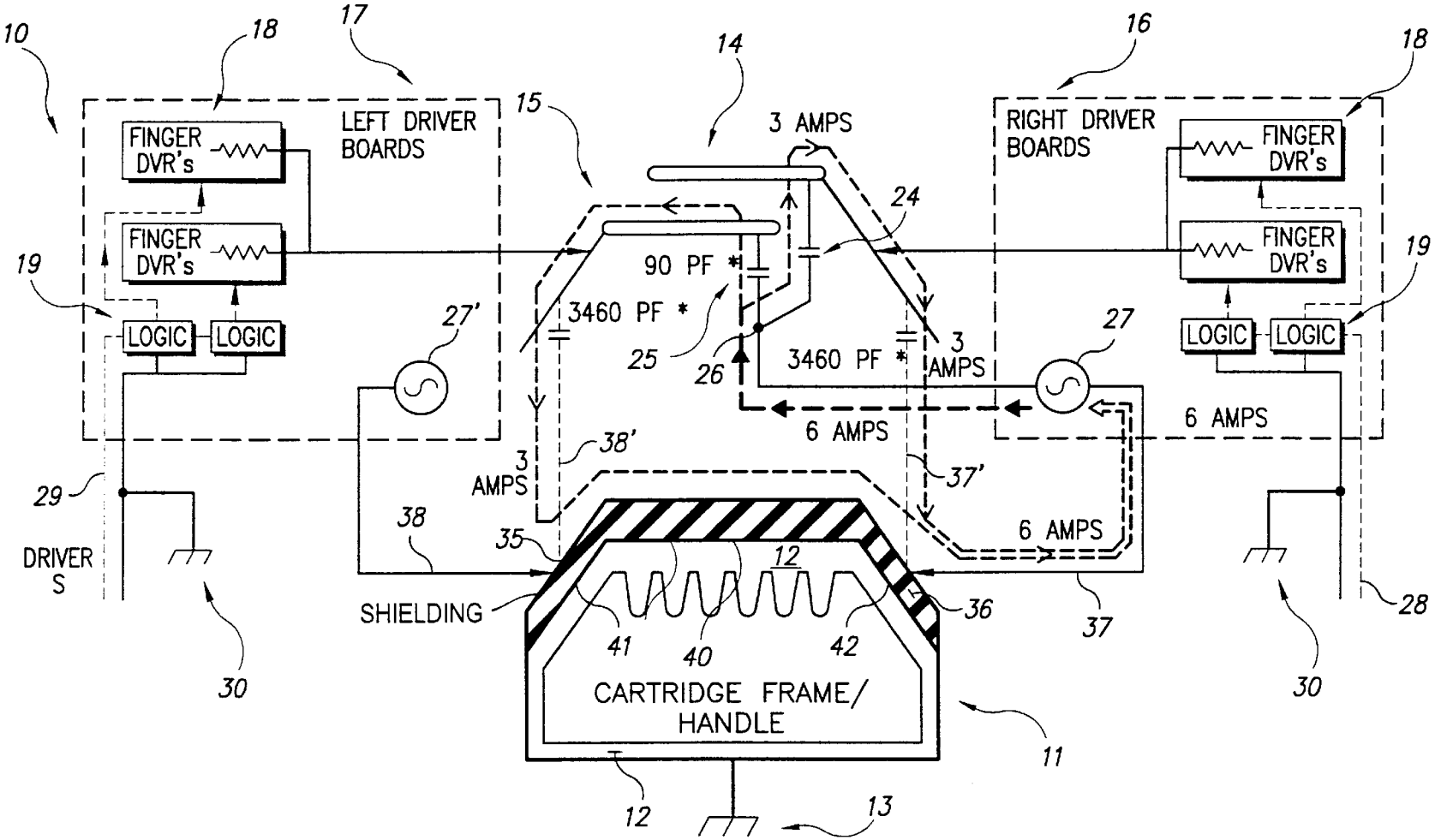
FIG. 3 is a view like that of FIGS. 1 and 2 only showing a second embodiment of the assembly according to the present invention, which embodiment has no screen electrode connections.

The invention, two embodiments thereof being illustrated at FIGS. 2 and 3, solves the problems caused by the uncontrolled RF current path of FIG. 1. In both the FIGS. 2 and 3 embodiments, a defined path for RF return currents is provided. Also, parasitic capacitance to the frame 11 is intercepted. In both FIGS. 2 and 3 components that are the same as those in FIG. 1 are shown by the same reference numeral.

In the embodiment of FIG. 2 the major changes compared to the prior art of FIG. 1 are the provision of shielding 35 of electrically conductive material, connected by an electrical insulator 36, to the mechanical cartridge frame/holder 11; and a plurality of electrical connections—e.g. the four connections 37, 37', 38, 38', illustrated in FIG. 2—between the RF generators 27 and the shielding 35. The shielding 35 is connected between the frame 11 and the conventional ion generator laminate (which includes the electrodes 14, 15 as well as the other structures described above). Because of the schematic nature of the illustration in FIG. 2 the laminate is not shown in contact with the shielding 35, but it will be in use.

A desired conventional frame 11 comprises an active area 40, and left and right sides 41, 42, respectively, as seen in FIG. 2. Preferably the shielding 35 and its associated electrical insulator 36, are provided on all of the active area 40 and the left and right sides 41, 42, as schematically illustrated in FIG. 2. Also, as seen in FIG. 2 (shown at 45 and 46 in FIG. 1) connections between the logic 19 and the capacitances 20, 21 in FIG. 1 have been removed, and the capacitances 20, 21 are directly connected by the electrical connections (e.g. two of 37, 37' 38, 38') to the shielding 35. Thus, the shielding 35 and the plurality of electrical connections 37, 37' 38, 38' provide a defined path for RF return currents and intercept parasitic capacitance to the mechanical cartridge frame 11.

While the shielding 35 may comprise a wide variety of structures, preferably it comprises a copper (or primarily copper) layer. The electrical insulator 36 may also comprise any suitable electrical insulator or combination of insulators, and may be provided in block form, in layers, or in any other suitable conventional configuration.

While the embodiment of FIG. 2 is successful in eliminating significant stray electrical noise, the embodiment of FIG. 3 is even more successful. While in the FIG. 2 embodiment, the left drivers 18 are operatively substantially directly electrically connected to the electrical connections 37, 38 by the capacitances 20, 21. In the FIG. 3 embodiment the drivers 18 are electrically connected to the electrical connections 37, 38 substantially only through the RF generators 27 and 27' (the typically ten left side generators being shown schematically at 27'). That is, in the FIG. 3 embodiment the capacitances 20, 21 have been eliminated. Also, in the FIG. 3 embodiment, the screen electrode in the ion generator laminate is not in an RF return current path.

Figure 4:
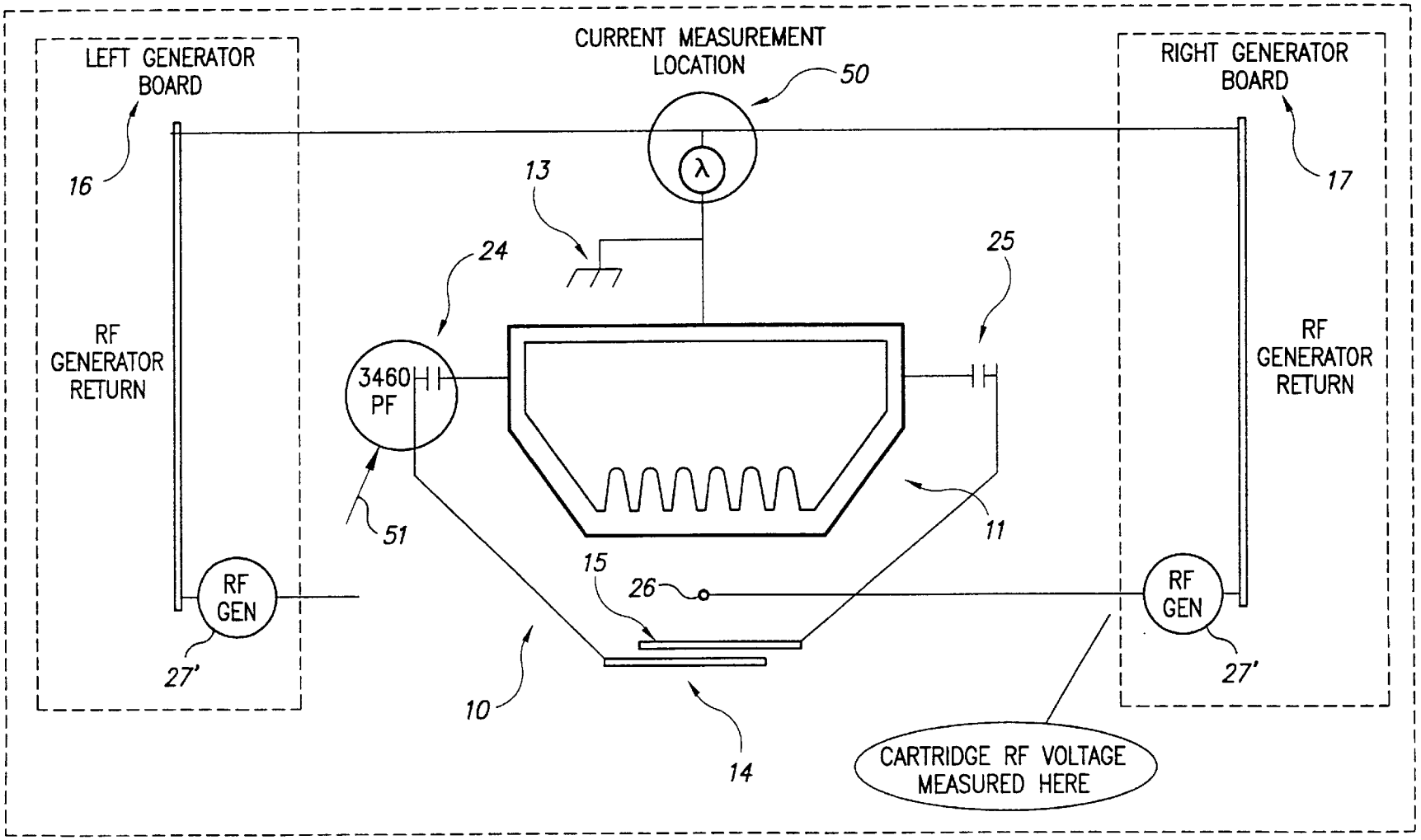
Fig. 4 PRIOR ART
FIG. 4 is an even more schematic representation of a prior art assembly of FIG. 1 highlighting the various connection points thereon used for testing.
Figure 5A:
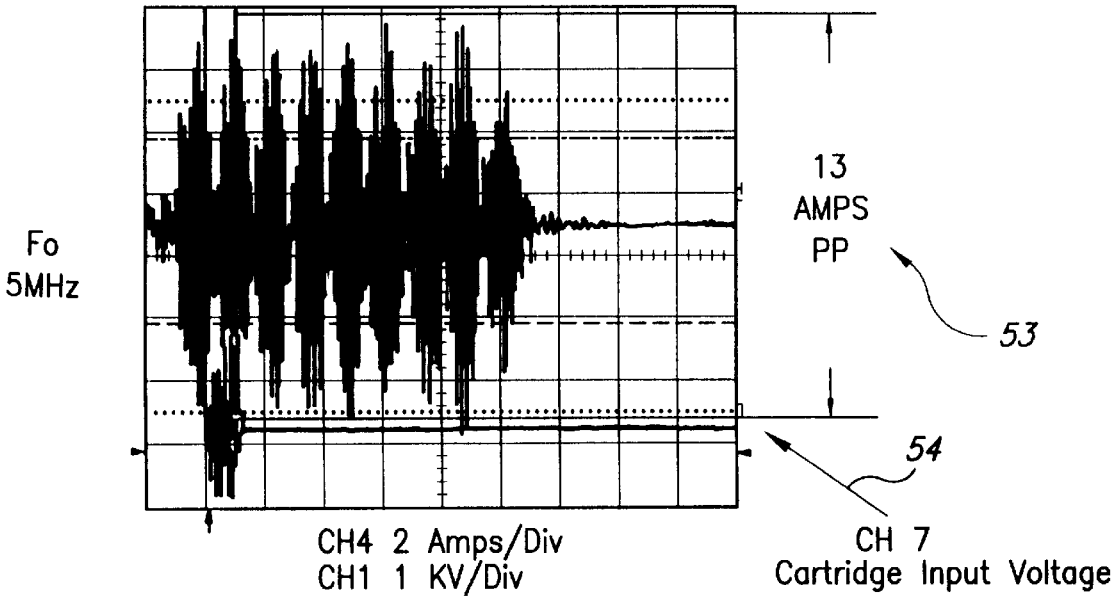
Fig. 5A (PRIOR ART)
FIGS. 5A and 5B are graphical representations of test results showing noise generated utilizing the assembly of FIG. 4.
Figure 5B:
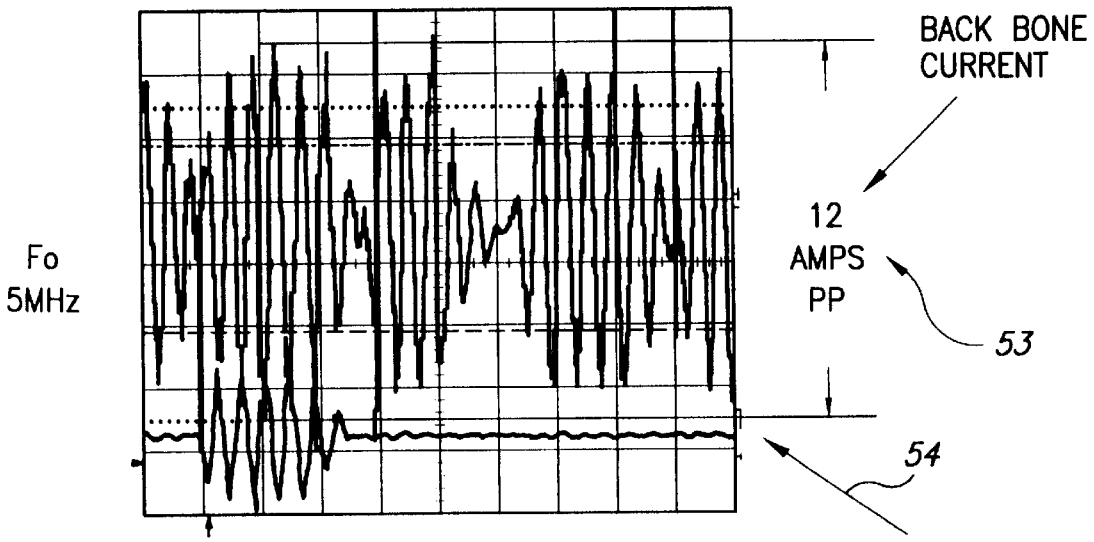
Fig. 5B (PRIOR ART)

According to the present invention when the assembly 100 according to the present invention of FIG. 3 was tested at 5 MHz, 2000 volts PP and compared to the prior art of the assembly 10 of FIG. 1, approximately a 19–20 db reduction in unwanted RF ground currents on the print cartridge's backbone and engine frame resulted. This represents a power ratio of 100:1. This is a significant reduction considering the RF generators are delivering 450 watts PK when operating at 2000 volts. According to the invention it is possible to reduce the hybrid load capacitance by at least about one-half, and decrease the finger electrode rise and fall times by at least about ½, and reduce the unswitched ground currents through the cartridge frame by at least about 15 db FIG. 4 shows the connection points for the assembly 10 of FIG. 1 for testing according to the present invention. The current measurement location is indicated schematically at 50 in FIG. 4. The circle 51 indicates finger capacitance to the cartridge frame 11 which is a total for the left/right sides of about 6920 P.F. In testing to determine the efficacy of the invention, the current at 50 was measured, and graphical plots were established. FIGS. 5A and 5B are plots of a measurement utilizing the system of FIG. 4 with the FIG. 5B plot display expanded in time. The backbone current in the plot of FIGS. 5A and 5B, shown generally at reference numeral 53, is about 12–13 amps PP. The cartridge input voltage is shown, for channel 7, at 54 in FIG. 5A.

Figure 6:
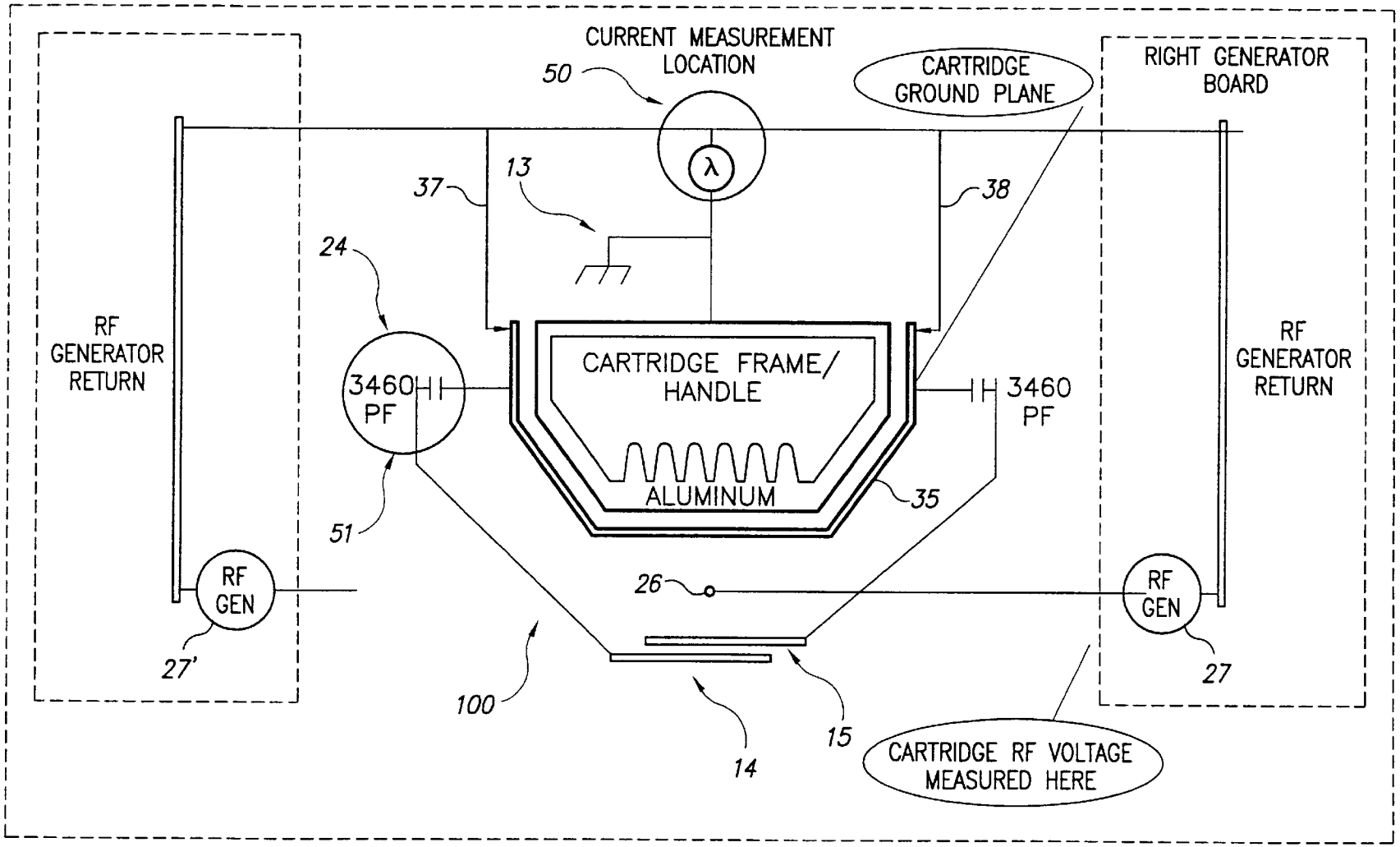
FIG. 6 is a view like that of FIG. 4 only showing the embodiment of FIG. 3 according to the present invention.
Figure 7A:
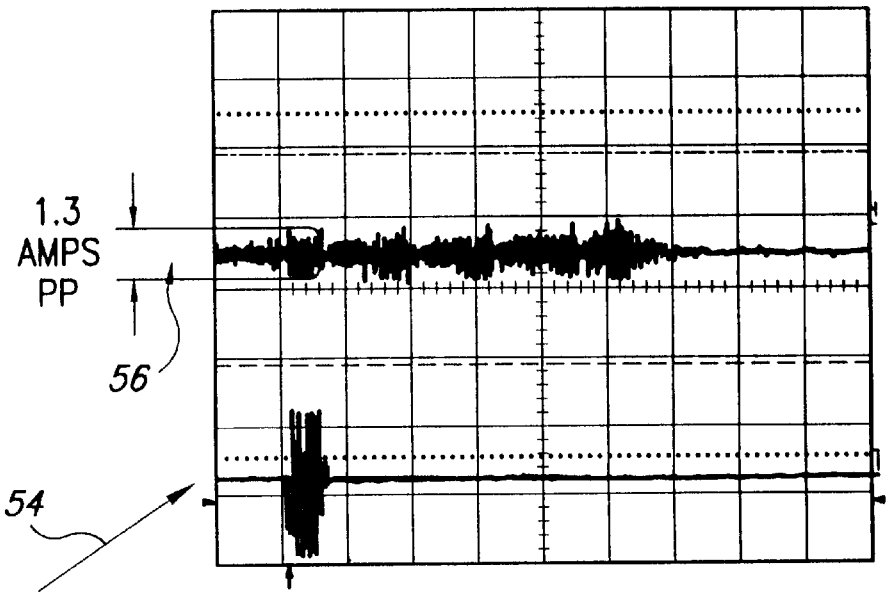
FIGS. 7A and 7B are graphical representations of the test results like those of FIGS. 5A and 5B only for the inventive assembly of FIG. 6.
Figure 7B:
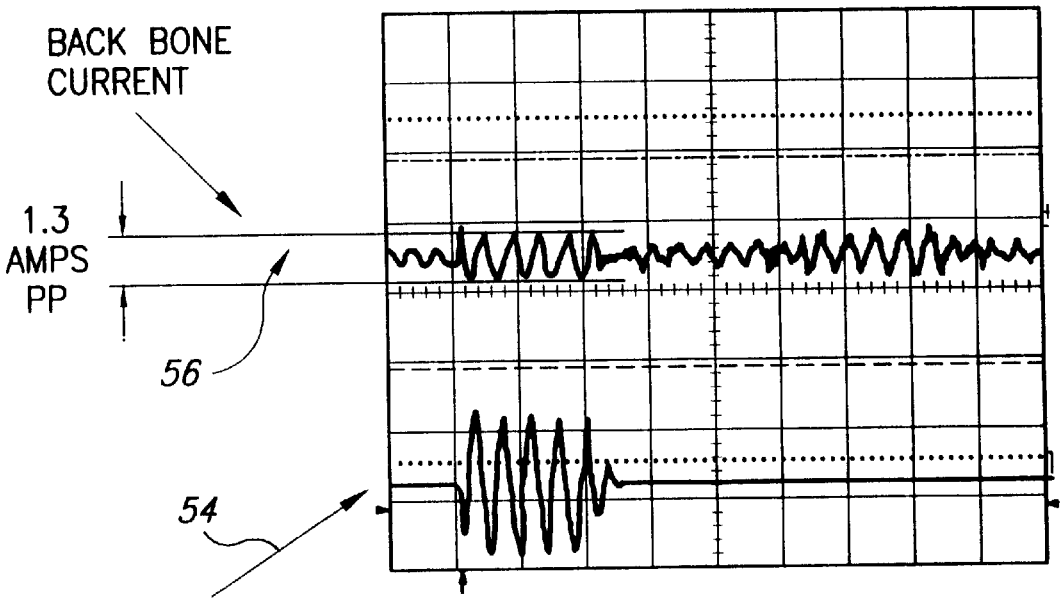

FIG. 6 is the same as FIG. 4 only for the assembly 100 according to the present invention (of FIG. 3). Again measurement current is taken at 50. FIGS. 7A and 7B correspond to FIGS. 5A and 5B only are the results of testing the assembly 100 of FIG. 6, again at 5 MHz, 2000 volts PP. Note that the backbone current 56 in FIGS. 7A and 7B is only about 1.3 amps PP, significantly less than the results from the prior art testing of FIGS. 5A and 5B.

According to the method of minimizing ground current through a printer frame in an electron beam printer according to the invention, there is provided: (a) Mounting shielding 35 of electrically conductive material and connected by an electrical insulator 36 to the mechanical cartridge frame 11. (b) Connecting the shielding 35 between the ion generator laminate (containing finger electrodes 14,15, a drive electrode, a dielectrode, and a screen electrode) and the mechanical cartridge frame 11 (particularly the aluminum peripheral surface 12 thereof). And (c) providing a plurality of electrical connections (37, 37', 38, 38') between the RF generators 27, 27' and the shielding 35 which provide a defined path for RF return currents to the RF generators 27, 27', and which intercept parasitic capacitance to the mechanical cartridge frame 11. The method further preferably comprises (d) electrically connecting the left and right drivers 16, 17 to the plurality of electrical connections 37, 37', 38, 38' substantially only through the RF generators 27, 27'. Typically (a)–(d) are practiced to reduce the hybrid load capacitance by at least about ½ (e.g. about 49–75%), decrease the finger electrode rise 14, 15 and fall times by at least about ½ (e.g. about 49–75%), and reduce the unswitched ground currents through the cartridge frame 11 by at least about 15 db (e.g. about 15–30 db), compared to if (a)–(d) are not practiced.

It will thus be seen that according to the present invention a highly advantageous electron beam printer imaging cartridge assembly, and subassembly, and method of minimizing ground current through a printer frame in such a printer, are provided. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures.

What is claimed is:

1. An electron beam printer imaging cartridge assembly comprising:

a mechanical cartridge frame at least partially of electrically conductive material, and connected to electrical ground;

an ion generator laminate, including electrodes, for generating electron printing beams;

a plurality of RF generators connected to said ion generator laminate;

shielding of electrically conductive material connected by an electrical insulator to said mechanical cartridge frame, and connected between said laminate and said mechanical cartridge frame; and a plurality of electrical connections between said RF generators and said shielding which provide a defined path for RF return currents and intercept parasitic capacitance to said mechanical cartridge frame.

2. An electron beam printer imaging cartridge assembly as recited in claim 1 wherein said mechanical cartridge frame comprises an active area and left and right sides; and wherein said shielding is provided on and electrically insulated from all of said active area and left and right sides of said mechanical cartridge frame.

3. An electron beam printer imaging cartridge assembly as recited in claim 2 wherein said shielding comprises a copper layer.

4. An electron beam printer imaging cartridge assembly as recited in claim 3 wherein said laminate includes left and right finger electrodes connected to left and right drivers, respectively, on left and right driver boards, respectively; and wherein said left and right drivers are operatively substantially directly electrically connected to said electrical connections.

5. An electron beam printer imaging cartridge assembly as recited in claim 3 wherein said laminate includes left and right finger electrodes connected to left and right drivers, respectively, on left and right driver boards, respectively; and wherein said left and right drivers are electrically connected to said electrical connections substantially only through said RF generators.

6. An electron beam printer imaging cartridge assembly as recited in claim 3 wherein said mechanical cartridge frame is constructed of aluminum where connected to said shielding through said electrical insulation, and where connected to ground, a continuous path of aluminum provided therebetween.

7. An electron beam printer imaging cartridge assembly as recited in claim 4 wherein said left and right drivers are connected to logic controls; and wherein said logic controls are electrically connected to said electrical connections substantially only through said RF generators.

8. An electron beam printer imaging cartridge assembly as recited in claim 5 wherein said left and right drivers are connected to logic controls; and wherein said logic controls are electrically connected to said electrical connections only through said RF generators.

9. An electron beam printer imaging cartridge assembly as recited in claim 1 wherein said laminate includes left and right finger electrodes connected to left and right drivers, respectively, on left and right driver boards, respectively; and wherein said assembly is devoid of finger electrode PCB capacitance connections to said RF generators.

10. An electron beam printer imaging cartridge assembly as recited in claim 2 wherein said mechanical cartridge frame is constructed of aluminum where connected to said shielding through said electrical insulation, and where connected to ground, a continuous path of aluminum provided therebetween.

11. An electron beam printer imaging cartridge assembly as recited in claim 9 wherein said left and right drivers are connected to logic controls; and wherein said logic controls are electrically connected to said electrical connections substantially only through said RF generators.

12. An electron beam printer imaging cartridge assembly as recited in claim 1 wherein said assembly comprises a 600 DPI 18 inch assembly.

13. An electron beam printer imaging cartridge assembly as recited in claim 1 wherein said laminate includes a screen electrode; and wherein said screen electrode is not in an RF return current path.

14. A method of minimizing ground current through a printer frame in an electron beam printer having a mechanical cartridge frame at least partially of electrically conductive material, and connected to electrical ground; an ion generator laminate, including electrodes, for generating electron printing beams; and a plurality of RF generators connected to the ion generator laminate; said method comprising:

(a) mounting shielding of electrically conductive material connected by an electrical insulator to the mechanical cartridge frame;

(b) connecting the shielding between the laminate and the mechanical cartridge frame; and (c) providing a plurality of electrical connections between the RF generators and the shielding which provide a defined path for RF return currents to the RF generators, and which intercept parasitic capacitance to the mechanical cartridge frame.

15. A method as recited in claim 14 wherein the laminate includes left and right finger electrodes connected to left and right drivers, respectively, on left and right driver boards, respectively; and further comprising:

(d) electrically connecting the left and right drivers to the plurality of electrical connections substantially only through the RF generators.

16. A method as recited in claim 15 wherein (a)–(d) are practiced to reduce the hybrid load capacitance by at least about ½, decrease the finger electrode rise and fall times by at least about ½, and reduce the unswitched ground currents through the cartridge frame by at least about 15 db, compared to if (a)–(d) are not practiced.

* * * * *